United States Patent [19]

Cook

[11] Patent Number: 4,920,383

[45] Date of Patent: Apr. 24, 1990

[54] PAPER HANDLING FOR REPETITIVE MOVEMENT OF VARIABLE LENGTH MEDIA THROUGH AN IMAGE TRANSFER STATION

[75] Inventor: William P. Cook, Longmont, Colo.

[73] Assignee: International Business Machines Corporation, Armonk, N.Y.

[21] Appl. No.: 322,961

[22] Filed: Mar. 14, 1989

[51] Int. Cl.[5] ..... G03G 15/00

[52] U.S. Cl. ..... 355/311; 355/271; 355/77

[58] Field of Search ..... 355/309, 311, 326, 327, 355/271, 272, 274, 318, 319, 77; 271/288, 301, 302

[56] References Cited

U.S. PATENT DOCUMENTS 4,443,094 4/1984 Ricciardi ..... 355/3
4,517,591 5/1985 Nagashima et al. ..... 358/75
4,526,459 7/1985 Bresnick ..... 355/319 X
4,595,279 6/1986 Kuru et al. ..... 355/14 R

FOREIGN PATENT DOCUMENTS 62-11695 5/1987 Japan .
2181415 4/1987 United Kingdom .

*Primary Examiner*—R. L. Moses
*Attorney, Agent, or Firm*—E. C. Hancock; C. E. Rohrer

[57] ABSTRACT

A plurality of paper paths are established for recirculating cut sheets through an image transfer station as in color xerography. Cut sheets of a variety of possible lengths are repetitively fed through the image transfer station by selecting the recirculating paper path that allows maximum machine throughput speed The shortest paper path is established by the peripheral circumference of a drum. Additional paper paths are established by combinations of gates, conveyors and/or drums positioned and controlled for receiving copy sheets longer than the first drum can accommodate.

10 Claims, 2 Drawing Sheets

PAPER HANDLING FOR REPETITIVE MOVEMENT OF VARIABLE LENGTH MEDIA THROUGH AN IMAGE TRANSFER STATION

TECHNICAL FIELD

The present invention relates to devices and methods for repetitively handling media of discrete but variable lengths relative to a work station. More particularly, the present invention relates to devices and methods for transferring images from an image carrier to a cut sheet where the cut sheet may have any of a range of physical dimensions. This invention is particularly useful for electrophotographic or xerographic printers or copiers which transfer image defining toner from a photoconductor to a cut sheet of paper and especially where such xerographic devices are associated with color image transfer requiring multiple passes of the copy sheet through a transfer station.

BACKGROUND OF THE INVENTION

There are circumstances where transfer of images from a carrier to a media so as to produce a visible image requires multiple passes of the copy receiving media past one or more image transfer stations. The combining of two images from an image source or sources onto a single receiving sheet frequently demands repetitive movement of the sheet past the work station. For instance, one application is where prestored information defining a form is combined with data to complete that form. Another application is the transfer of color images which requires accurate recycling of the media through the transfer station to create a composite of different color elements such as from ribbons or ink sources. In the case of copiers and printers using electrophotographic or xerographic processes, different charge patterns are applied from the photoconductor to the copy sheet with intervening applications of different color toners correlating to the particular color image transferred.

Thus devices have evolved for recycling the image receiving copy media past an image transfer station. An example is U.S. Pat. No. 4,517,591 by Nagashima et al wherein the copy sheet is held on the peripheral surface of a drum by leading and trailing edge grippers. Such a system may function satisfactorily as long as the copy sheets are all of the same length.

An attempt to handle variable length sheets is suggested in U.S. Pat. No. 4,595,279 by Kuru et al which controls the speed of the sheet drive elements associate with the drum and the fuser. An arrangement for securing variable length copy sheets to a transfer drum is shown in Great Britain Pat. No. 2,181,415 which includes moveable rollers and suction cup grippers on the surface of the transfer drum. It requires physical intervention to set these components once the anticipated copy sheet size dimensions are known.

Another device for handling duplex copy transfer in the environment of a duplicator machine is shown in U.S. Pat. No. 4,443,094 by Ricciardi. An impression cylinder has an edge gripper and a continuously recycling chain with dual grippers cooperating to allow a first side imaging of the copy sheet after which the chain grippers strip the sheet from the cylinder and reverse it so the cylinder grips the trailing edge of the flipped sheet. To handle copy sheets of different lengths, it is necessary to physically relocate the grippers on the chain as well as to adjust the timing of the machine operation.

Accordingly, the prior art can accommodate variable sized copy sheets only by either physical relocation of sheet handling elements or by utilization of recycling paper path elements that establish a sufficiently long paper path to contain the longest sheet anticipated for use in the image transfer process. Unfortunately, such long paper paths penalize the machine in that its maximum throughput is tied to the length of the longest copy sheet the machine might encounter.

SUMMARY OF THE INVENTION

This invention is concerned with machines and processes for repetitively passing media units, such as cut sheets, through a work station having input and output locations for the media. Improvements in accordance with the invention include establishment of a first path for transporting the media of a length equal to, or shorter than, a predetermined minimum dimension as measured in the intended direction of movement of the media. This first path extends from the work station output location to the work station input location.

Since the first path is only long enough to contain the shortest media sheets, a second path is employed and is selectively operable for transporting the media over the second path from the output to the input of the work station. By arranging this second path so as to have a length in the direction of media movement greater than the first path, longer media sheet handling is possible without penalizing the machine throughput speed when handling the shorter media. It is also possible to include additional paths beyond the second path so that the imaging process is accomplished at optimum speed for any given copy sheet media.

Apparatus to establish the aforementioned first and second paths can include a drum. In that case, the first path drum will have a peripheral circumference corresponding to the shortest length of media the machine is to handle. Each of those drums can include grippers for retaining media on the surface thereof. By a selectively operable control of a gate, it is possible to divert media having a length in the direction of movement through the work station which is longer than the circumference of the first drum into the second drum gripper.

The length of the copy media in the direction of movement through the paths is obtainable by user entry of data identifying the length, by machine sensing of the sheet length before it arrives at the work station, or the like. This information determines which path to select for optimum machine throughput speed.

Thus the present invention is a method and means having particular utility for establishing paper paths for a multiple transfer xerographic or electrophotographic (EP) system to handle variable paper sizes. Color EP systems which employ multiple toned photoconductor images and use a transfer roll are forced in the prior art to configure that roll to handle the maximum size copy sheet paper. This invention allows the transfer roll dimensions to double making the machine capable of handling many paper sizes without discounting maximum system throughput rates.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENTS

Figure 1:
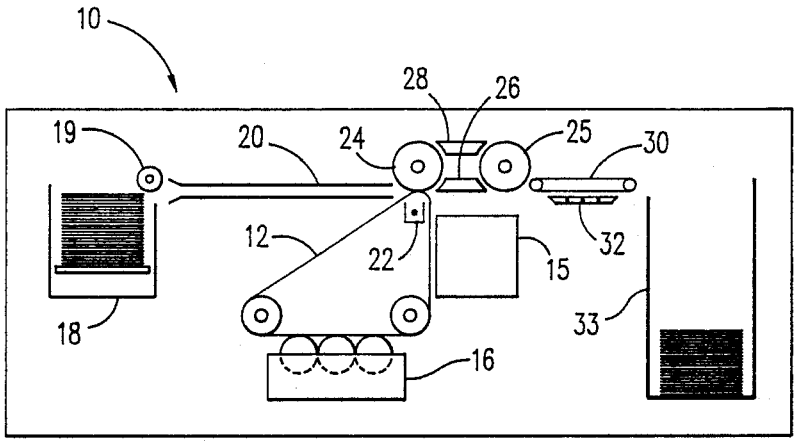
FIG. 1 is a somewhat schematic view of a typical xerographic machine environment incorporating the present invitation.

A xerographic or electrophotographic printer 10 is shown in FIG. 1 which includes many contemporary elements used for image transfer. Ā flexible belt 12 with a photoconductor surface is selectively discharged to define an image as by an LED array, laser, optical document scanner or the like from source 15. Belt 12 passes through developer 16 which, in this example, has three developer rollers with each such roller selectively operable in response to machine controls for applying a different color of toner to the surface of belt 12. It could have more or less toner applying devices. The toner defined image is thereafter transferred to a copy sheet at transfer station associated with transfer corona 22 as is conventional. Frequently machine 10 will include several other elements associated with the EP process but which are not shown, such as discharge and cleaning stations and the like. These items are conventional and thus a description thereof is omitted here.

The image receiving media for the printer 10 is cut sheets of paper stacked in supply bin 18. The floor of bin 18 is raised in operation so that individual sheets are motivated by picker roller 19 into input path 20. By conventional controls, image defining panels of toner on the photoconductor 12 are transferred to the sheets via transfer corona 22. Sheets containing completed copies eventually are delivered to output vacuum conveyor 30 where they pass in proximity to flash fuser 32 to fix the image thereon. The final product is delivered to the receptacle 33 which may include a stapler or binder and/or a collator.

Multiple transfer EP technology, such as in color imaging, typically uses a transfer roll along the lines of roll 24 or equivalent to hold the copy sheet paper during sequential toner transfer iterations. The copy sheet is secured to the external circumference of roll 24, and it rotates so the sheet passes the transfer station however many times is required to complete the transfer of the complete image.

In the past, the choice of the circumference of roll 24 involved a trade-off between the maximum paper dimension the system must handle and the system throughput in pages per minute. Increasing the roll 24 circumference allows handling of more paper sizes but the throughput drops proportionately.

Figure 2:
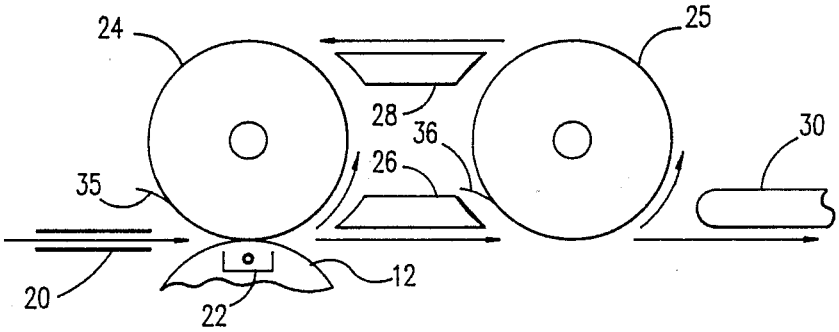
FIG. 2 is an expanded view of the paper path defining components employed in FIG. 1.

In accordance with the present invention, the throughput of the machine is maintained at its optimum rate by providing a plurality of optionally selectable paper paths between the output of the work station and the input thereof. In the particular preferred embodiment example of FIGS. 1 and 2, a second roll 25 is included along with interconnecting paper transport elements, such as vacuum transports 26 and 28.

Although not shown, appropriately placed paper gates and strippers are strategically located relative to the paper paths. In the example shown, this would typically include a selectively operable gate to divert a longer sheet from drum 24 onto vacuum transport 26, a static stripper means to remove the sheets from drum 25 onto vacuum transport 28, and means to open and close drum grippers 35 and 36 on respective drums 24 and 25 to engage the sheet leading edge as needed, all as a function of the paper size in use at the moment. Another selectively operable gate (also not shown) can either intercept the sheets and direct them into output conveyor 30 or urge them towards gripper 36 on the periphery of drum 25.

The length of a given sheet that machine 10 must handle is identified by contemporary devices or processes. The user can enter that information manually, or the supply bin or cassette can have edge sensors incorporated therein to signal the machine 10 controls. Further, automatic sensing associated with the copy sheet input path can identify the sheet length to the machine 10 controls. These controls then utilize that information to specify which gates are operable as well as the timing of their operation.

Assuming the smallest paper size that the system must accommodate is 8.5 inches and the largest is 17.0 inches, drums 24 and 25 can have equal diameters as long as the intervening transports 26 and 28 have adequate lengths to handle tangent-to-tangent sheet transfers between drums 24 and 25. On a pure mathematical basis, this would suggest diameters of about 2.7 inches for drums 24 and 25 with a length of about 2.1 inches for transports 26 and 28. In a practical design, dimensions along the lines of 3.0 inches for the diameters of drums 24 and 25 with 4.5 inch separation between the axis of those drums would account for factors such as any unusable surface of the drums because of the grippers, tolerances, etc..

Smaller paper sizes have a somewhat better image to image registration because the paper is fixed on roll 24 only. Adequate registration is achieved using both rolls 24 and 25 by driving the sheets back into paper clamp 35 on roll 24 as it approaches the output of conveyor 28 causing a slight buckle between the rolls 24 and 25. It might prove helpful to detect the front or back edge of the sheets for adequate registration in the opposite dimension. Note that gripper clamp 35 must securely receive the leading edge of both large and small sheets.

By the disclosed apparatus, color reproduction of large size prints (e.g., 17 inch) is accomplished using a machine that is not penalized in throughput speed for smaller (e.g., 8.5 inch) reproduction. The throughput for smaller sizes is not impacted by providing the machine with the capability of producing large prints.

In color reproduction operation for smaller size sheets, the sheet is introduced to gripper clamp 35 which holds it for multiple passes through the transfer or imaging station associated with transfer corona 22. Each pass transfers toner of a different color to make up the composite color image. Larger sheets are allowed to pass through the transfer station onto conveyor 26 which introduces the sheet to gripper 36 on drum 25. Gripper 36 releases the larger sheet in proximity to the upper tangent of drum 25 so that conveyor 28 returns it to gripper 35 on drum 24. As the larger sheet passes again through the transfer station for another color toner transfer, gripper 35 releases it to start another passage around the loop including transports 26 and 28 as well as drum 25.

It is possible to establish additional paper paths from the transfer station output to its input by any of several different arrangements. For instance, utilization of more than two drums can provide such a result. Another configuration for this purpose is shown in FIG. 3 wherein elements which function the same as previously described are given similar reference numbers including transfer drum 24 with its gripper clamp 35, input paper guide 20 and transfer corona 22.

Figure 3:
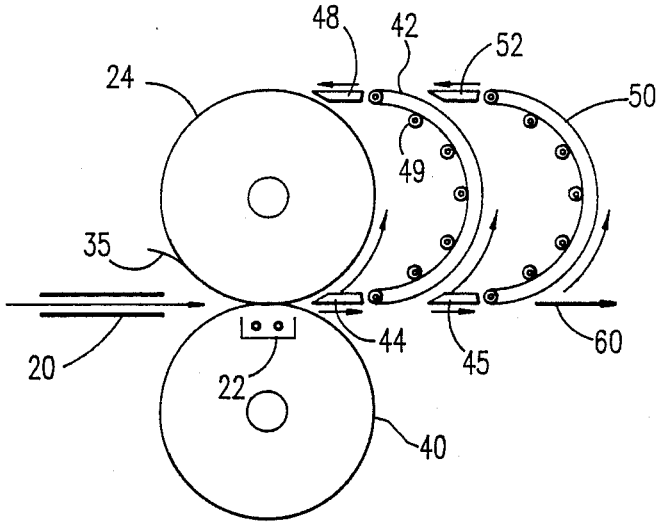
FIG. 3 is another embodiment of paper path defining components in accordance with this invention.

However, in FIG. 3, the image carrier is shown as a drum 40 with a photoconductor surface instead of a photoconductor belt. Drum 24 is dimensioned to handle the smallest size copy sheet as discussed above, but its output is gated into either of two return paths 42 or 50, or into the machine exit path 60. An intervening conveyor 44 carries the sheets to the throat of continuous loop conveyor 42 where a gate (not shown) either allows them to pass to the next intervening conveyor or diverts it onto conveyor 42.

Conveyor 42 is a continuous loop belt or chain type conveyor which carries sheets received from the transfer station and conveyor 44 onto conveyor 48 for gripping by clamp 35 on drum 24 and recycled movement through the transfer station as described above. The belt for conveyor 42 is held clear of drum 24 as by a series of rollers such as 49. Additional rollers supporting the belt and/or sheets can define the sheet conveying arcuate surface opposite rollers 49 if desired.

Conveyor 50 functions in a manner similar to conveyor 42. A gate is operated in response to signals from the machine controls so as to either allow the sheets from intermediate conveyor 45 to continue to output path 60 or divert them onto the continuous belt of conveyor 50. Another intermediate conveyor 52 passes the sheets to conveyor 48 which in turn returns them to drum 24. Accordingly, a machine implemented pursuant to a FIG. 3 arrangement can realize maximum throughput speeds for not only the smallest and largest sheet sizes but also for intermediate sheet sizes.

For example, the paths for output to input for the transfer station could include the circumferential path around drum 24 for the shortest sheet of 8.5 inch length, a path associated with conveyor 42 and drum 24 for 11 inches and a path around conveyor 50 and drum 24 for 17 inch sheets. Of course, inclusion of additional return paths can permit handling of a greater number of sheet lengths, if desired.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. In a machine for repetitively passing media units such as cut sheets in a first direction through a work station having input and output locations for respectively receiving and discharging the media, an improvement comprising means establishing a first path for transporting media of a predetermined minimum dimension in said first direction with said first path extending from the work station output location to the work station input location, and means selectively operable for transporting the media over a second path from the output to the input of the work station, said second path having a length in said first direction of media movement greater than said first path.

2. Apparatus in accordance with claim 1 wherein said first and second paths each include a drum with said first path drum having a circumference corresponding to the shortest length of media said machine is to handle.

3. Apparatus in accordance with claim 2 wherein each of said drums includes gripper means for retaining media on the surface thereof, and said selectively operable means includes control means and gate means for diverting media having a length in the direction of movement through the work station longer than the circumference of said first drum into said second drum gripper means.

4. Apparatus in accordance with claim 1 which includes a plurality of said selectively operable media transporting means each establishing a respective said paper path for handling media sheets of different lengths.

5. A machine for repetitively passing cut sheet media in a first direction through an image transfer station with input and output locations for respectively receiving and discharging the media with respect to the transfer station wherein the image is delivered into said transfer station by a moving image carrier comprising a rotatable drum having means for receiving media sheets from the transfer station output location and for retaining the media sheets thus received on the circumferential surface of said drum with the length of said circumferential surface corresponding to a predetermined minimum length of cut sheets in said first direction which said machine is to handle, means positioning said drum for engaging the moving image carrier at the transfer station for allowing passage of media sheets therebetween, and conveying means selectively operable for receiving media sheets of a length in the first direction greater than said predetermined minimum length from the transfer station output location and for delivering the media sheets to said drum surface for return to the transfer station input location by said drum for a repetitive passage of the media sheets through the transfer station, the length of the media path from the transfer station output location to the input location by way of said conveying means accommodating a predetermined maximum media length in the first direction which the machine must handle, whereby the machine operates at optimum throughput speed by selecting said conveying means whenever the machine must handle media sheets of a length greater than said predetermined minimum.

6. Apparatus in accordance with claim 5 wherein said conveying means includes a second drum.

7. Apparatus in accordance with claim 6 wherein said conveying means further includes first means for transporting the media sheets from the transfer station output location and second means for transporting the media from said second drum to said first drum.

8. Apparatus in accordance with claim 5 which further includes second conveying means selectively operable for receiving media sheets of a length in the first direction intermediate of said predetermined minimum and maximum lengths from the transfer station output location and for delivering the media sheets to said drum surface for return to the transfer station input location by said drum for a repetitive passage of the media sheets through the transfer station, the length of the media path from the transfer station output location to the input location by way of said second conveying means accommodating said intermediate length media.

9. A method for optimizing the throughput rate of a machine which must repetitively pass cut sheets through a work station wherein said sheets may have a length within a range defined by a predetermined minimum and a predetermined maximum comprising the steps of establishing at least first and second return paths from the work station output to its input with said first path having a length corresponding to said predetermined minimum and said second path having a length corresponding to said predetermined maximum, determining the length of a media sheet introduced to the work station, directing the media sheet into said first path in response to a said determining step result indicative that the media length is equal to or less than said predetermined minimum, and directing the media sheet into said second path in response to a said determining step result indicative that the media is of a length greater than said minimum.

10. The method in accordance with claim 9 which includes the step of recycling the media sheet around the path selected by said directing steps for repetitive passage of said media sheet through the work station.

* * * * *